US005810500A

United States Patent [19]

Whaley

[11] Patent Number: 5,810,500

[45] Date of Patent: Sep. 22, 1998

[54] RING BINDER

[75] Inventor: Paul Whaley, County of St. Francois, Mo.

[73] Assignee: US Ring Binder Corp., New Bedford, Mass.

[21] Appl. No.: 806,095

[22] Filed: Feb. 25, 1997

[51] Int. Cl.[6] ..... B42F 3/04

[52] U.S. Cl. ..... 402/31; 402/37; 402/38; 402/42

[58] Field of Search ..... 402/31, 36, 37, 402/38, 39, 40, 41, 42

[56] References Cited

U.S. PATENT DOCUMENTS

| | | | |
|---|---|---|---|
| 794,290 | 7/1905 | Ford | 402/41 |
| 1,625,752 | 4/1927 | Sterling | 402/38 |
| 3,246,652 | 4/1966 | Lang | 402/37 |
| 4,368,995 | 1/1983 | Cohen | 402/39 |
| 5,348,412 | 9/1994 | Fuller | 402/31 |
| 5,577,852 | 11/1996 | To | 402/31 |
| 5,618,122 | 4/1997 | Constantine | 402/31 |

*Primary Examiner*—Daniel W. Howell
*Assistant Examiner*—Adesh Bhargava
*Attorney, Agent, or Firm*—Polster, Lieder, Woodruff & Lucchesi L.C.

[57] ABSTRACT

A ring binder (10) comprises a pair of leaves (28, 30) hingedly connected to each other for relative movement therebetween. A plurality of spaced binder rings (22, 24, 26) are each formed of a pair of ring halves (22*a,* 22*b,* 24*a,* 24*b,* 26*a,* 26*b*). One end (22*c,* 22*d,* 24*c,* 24*d,* 26*c,* 26*d*) of each ring half is attached to one of the leaves. Movement of the leaves thus moves the opposite end of the respective ring halves out of and into contact with each other so to open and close the binder. A shield (20) covering the leaves has spaced openings (42) through which the ring halves extend. The shield has a plurality of raised sections (44, 46, 48) extending transversely of a longitudinal axis of the shield with one of the raised sections being formed at each binder ring location. Another raised section (52) extends axially of the longitudinal axis of the shield and intersects each of the transversely extending raised sections. Both the axially extending raised section and the transversely extending raised section are being formed in the shield to increase the strength of the shield. Detends (62, 64) of a geometric shape are formed in the longitudinally extending raised section to further strengthen the shield.

30 Claims, 3 Drawing Sheets

RING BINDER

BACKGROUND OF THE INVENTION

This invention relates to ring binders, and more particularly, to an improved ring metal assembly for a ring binder in which the strength of a shield or cover for the ring metal is increased to assist in preventing inadvertent opening of the ring binder.

In a ring binder for holding and storing paper, the portion of the assembly which attaches to the spine portion of the binder is commonly referred to as a "ring metal". The ring metal typically includes a plurality of spaced rings each of which is comprised of ring halves of each ring. When the binder is open, the ring halves are pulled apart so a sheet of paper or the like can be inserted in the binder by inserting holes formed in the sheet through one of the ring halves. When the binder is closed, the ring halves are closed upon each other to hold and store the sheet. A ring metal construction is shown, for example, in U.S. Pat. No. 5,286,128 which is assigned to the same assignee as the present application. As shown therein, each ring half has one end attached to a hinged leaf. There are two such leaves which extend logitudinally of the ring metal in a side-by-side arrangement. The leaves are hinged together so they flex in one direction or another for opening and closing the binder. In addition, the ring metal includes a shield which comprises an arcuate cover that fits over the leaves.

As shown in the '128 patent, at the location of each ring there is a band or rib formed by a raised section of the shield. Each band extends transversely of the longitudinal axis of the shield. This is done to strengthen the shield across the width of the cover. While the provision of these bands or ribs strengthen the shield, the shield can be further strengthened and such additional strengthening can significantly improve the ability of the ring metal to not be inadvertently or accidentally opened regardless of the treatment to which the ring binder is subjected.

BRIEF SUMMARY OF THE INVENTION

Among the several objects of the present invention may be noted the provision of a ring binder for use in storing papers and the like;

the provision of such a ring binder having a ring metal with a plurality of binder rings each of which is comprised of separate ring halves;

the provision of such a ring binder in which the ring halves forming each ring have ends movable out of and into contact with each other to open and close the binder;

the provision of such a ring binder having a ring metal shield with a raised section or rib extending transversely of the longitudinal axis of the shield at each ring location thereby to strengthen the shield and make it more difficult for the rings to be inadvertently opened;

the provision of such a ring binder wherein the shield further include a raised section extending longitudinally of the shield between each of the ribs to further strengthen the shield;

the provision of such a ring binder wherein the shield further includes detents formed in the longitudinal raised section to still further strengthen the shield;

the provision of such a ring binder in which a plurality of spaced detents are formed in each longitudinal raised section;

the provision of such a ring binder in which the detents formed in each longitudinal raised section form a decorative pattern, the detents forming a "diamondback" pattern, which enhances the appearance of the ring metal;

the provision of such a ring binder in which the raised sections of the cover, both longitudinally and transversely may comprise any of a number of different profiles depending upon the shape and configuration of the raised sections so to increase the strength of the ring metal;

the provision of such a ring metal to be available in various sizes and for use with different numbers of binder rings; and, the provision of such a ring binder which is readily manufactured and is of a sturdy construction.

In accordance with the invention, generally stated, a ring binder comprises a pair of leaves which are hingedly connected to each other for relative movement therebetween. A plurality of spaced binder rings are each formed of a pair of ring halves. One end of each ring half is attached to one of the leaves. Movement of the leaves thus moves the opposite end of the respective ring halves out of and into contact with each other so to open and close the binder. A shield covering the leaves has spaced openings through which the ring halves extend. The shield has a plurality of raised sections extending transversely of a longitudinal axis of the shield with one of the raised sections being formed at each binder ring location. Another raised section extends axially of the longitudinal axis of the shield and intersects each of the transversely extending raised sections. Both the axially extending raised section and the transversely extending raised section are formed in the shield to increase the strength of the shield. Other objects and features will be in part apparent and in part pointed out hereinafter. Detends are also formed in the longitudinally extending raised section to still further strengthen the shield. The detends from a "diamondback" pattern.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figures 1, 2, 6:
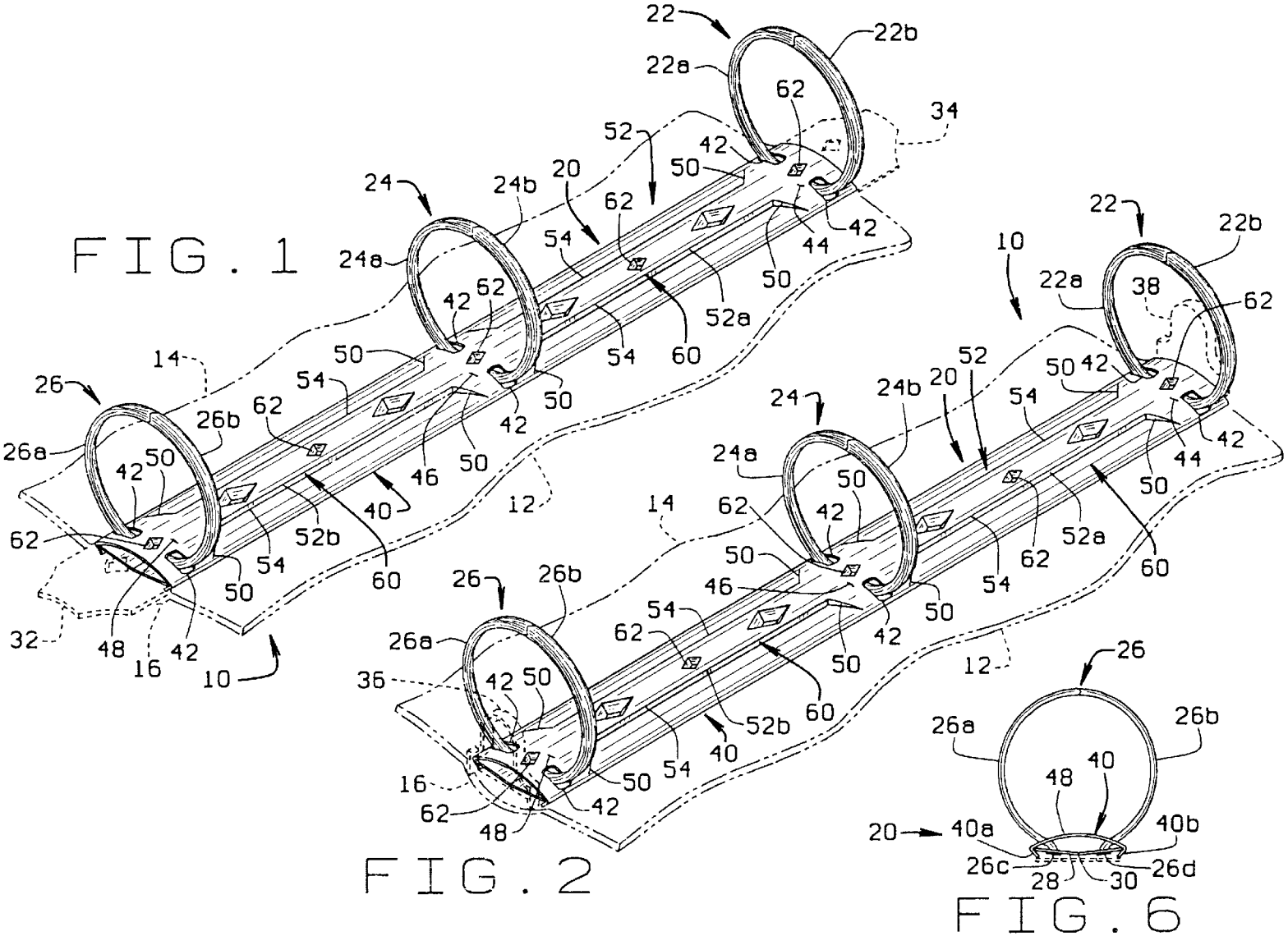
FIG. 1 is a perspective view of a ring binder metal of the present invention for use in a ring binder having a first type of end release mechanism.
FIG. 2 is a perspective view of a ring binder metal of the present invention for use in a ring binder having a second type of end release mechanism.
FIG. 6 is an end view of the ring binder metal.
Figure 3:
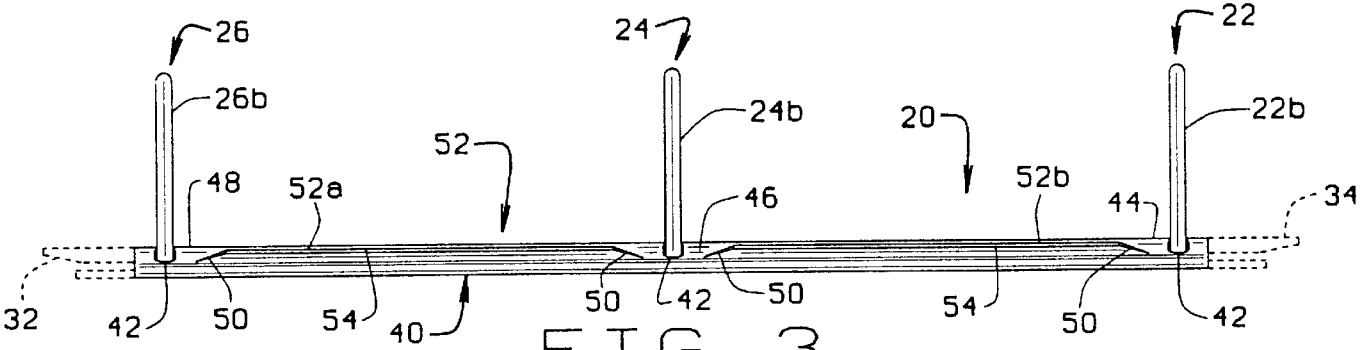
FIG. 3 is a side elevational view of the ring binder metal.

Referring to the drawings, a ring binder indicated generally 10 in FIGS. 1 and 2 has respective end covers 12 and 14, and a spine section 16 intermediate the end covers. As is well-known in the art, the ring binder is to used to store punched sheets of paper (not shown) or other suitably hole punched material. The ring binder is also available in various sizes so to be able hold different quantities of paper or other material. For this purpose, the ring binder is equipped with a "ring metal" 20 which is shown in FIGS. 1 and 2 to be attached to spine section 16 of the ring binder. The ring metal includes a plurality of openable and closeable binder rings 22, 24, 26 which are spaced axially along the ring metal. Each ring is comprised of respective ring halves 22*a*, 22*b*, 24*a*, 24*b*, and 26*a*, 26*b*. It will be understood that while three binder rings are shown in the drawings, a ring binder may have more, or fewer, rings without departing from the scope of the invention.

Figure 4:
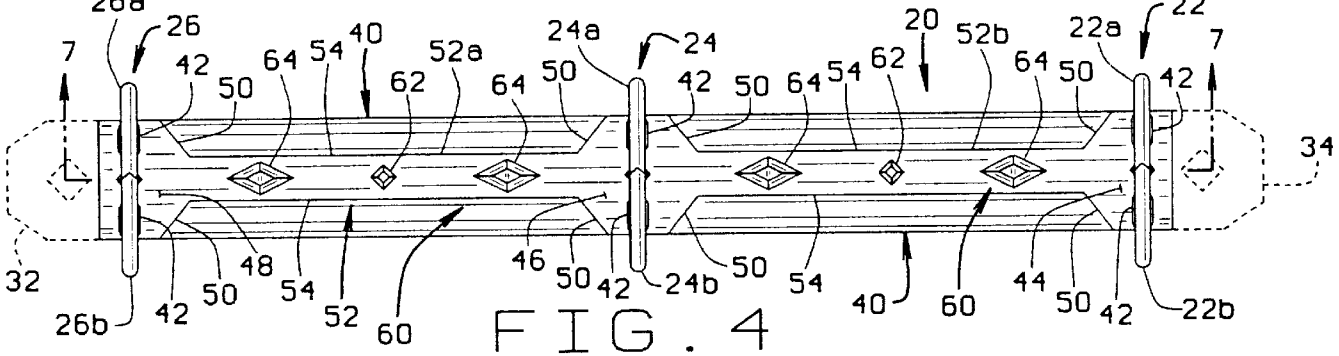
FIG. 4 is a top plan view of the ring binder metal.
Figure 5:
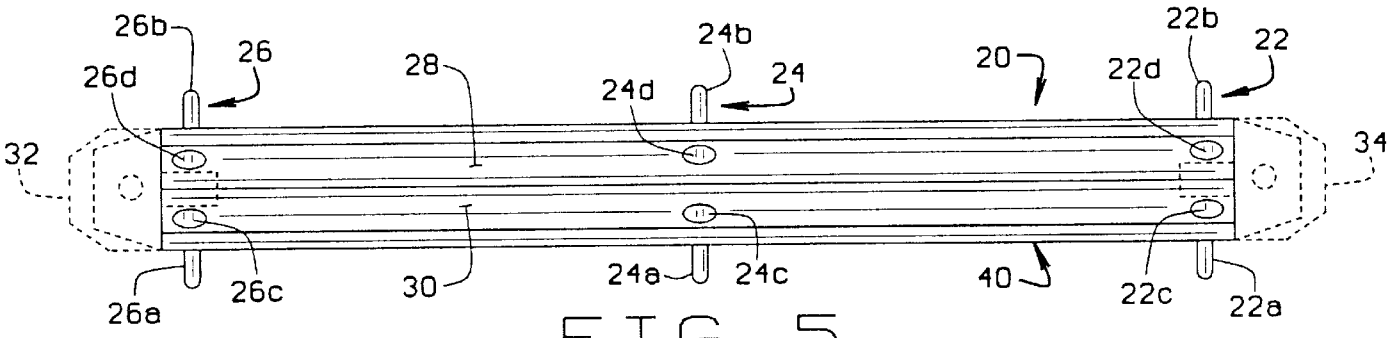
FIG. 5 is a bottom plan view of the ring binder metal.
Figure 7:
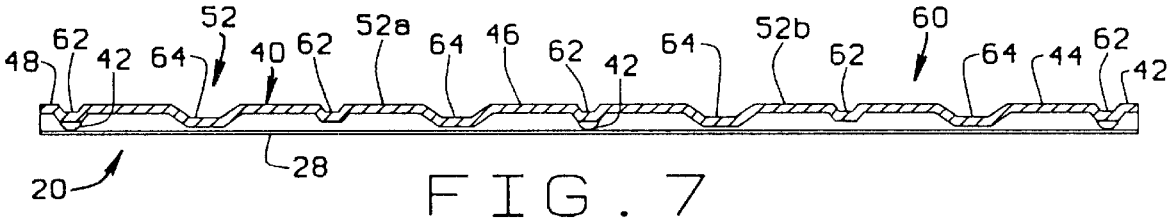
FIG. 7 is a sectional view of the ring binder metal taken along line 7—7 in FIG. 4.

The ring metal further includes a pair of leaves 28,30 which extend longitudinally of the ring metal (see FIG. 5). Each leaf is comprised of a rectangular plate and the plates extend parallel to each other substantially along the length of the ring metal. The leaves are hingedly connected to each for relative movement between the leaves when the ring binder is opened or closed. Each ring half has a base end 22*c*, 22*d*, 24*c*, 24*d*, and 26*c*, 26*d* which is secured to one of the respective leaves, as shown in FIG. 5. As shown in FIG. 4, the other end of the ring halves for each binder ring are formed so to interfit with each other when the ring binder is closed. Mounted on opposite ends of the ring metal are release levers 32,34 (as shown in FIG. 1) or 36,38 (as shown in FIG. 2). These release levers are rotated by the user to force the hinged leaves into a downward V configuration, to open the binder, or an upward V configuration, to close the binder. Operation of the release levers to move the leaves in the appropriate direction to or close a binder is well understood in the art, and will not be described.

The ring metal further includes a cover or shield 40 which fits over and encloses the leaves 28,30 as shown in FIG. 6. The cover has spaced openings 42 formed therein at the location of each binder ring 22, 24, 26. The outer portion of each of the binder ring halves extends through one of these openings in the cover. Further, at the location of each binder ring, a raised section or band 44, 46, or 48 extends across the cover transversely of the longitudinal axis of the cover. These bands are formed by a stamping operation during manufacture of the cover and the resulting transition or discontinuity in the cover creates ribs 50 which strengthen cover 20 across the width of the cover.

Figure 8:
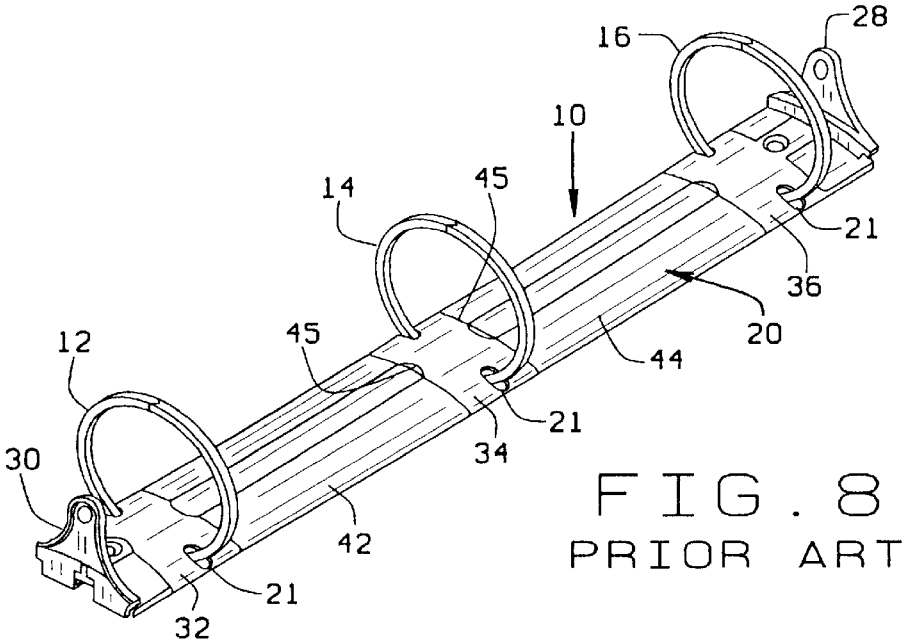
FIG. 8 PRIOR ART
FIG. 8 is a perspective view of prior art ring binder metal construction.
Figure 9:
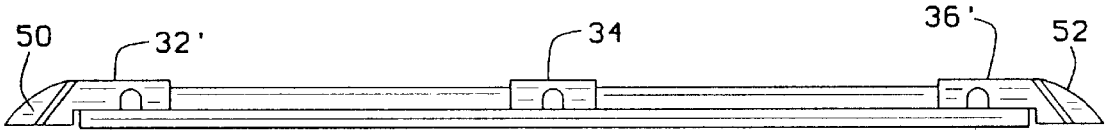
FIG. 9 PRIOR ART
FIG. 9 is a side elevational view of the prior art ring binder metal.

Referring to FIGS. 8 and 9, a prior art cover having transversely extending bands formed in the cover at the location of each binder ring is shown. The ring metal depicted in FIGS. 8 and 9 is shown and described in co-assigned U.S. Pat. No. 5,286,128 the teachings of which are incorporated herein by reference. As described therein, during assembly of the ring metal, formation of the ribs adds stiffness to the cover to help retain legs 40*a*, 40*b* (see FIG. 6) in parallel with each other when the ring binder is opened. Although not shown in the drawings, when the ring binder is opened, legs 40*a*, 40*b* flex outwardly and downwardly from their position shown in FIG. 6 until the legs extend parallel to each other.

In accordance with the present invention, it has been found that cover 20 can be further strengthened. This is accomplished in two ways. First, a raised section or rib 52 is now formed in the cover, this raised section extending longitudinally of the cover. As shown in the drawings, this raised section extends from one end of the cover to the other. Raised section 52 comprises respective sub-sections 52*a*, 52*b*. One of the sub-sections extends between the binder ring at one end of the ring metal to the center binder ring, and the other sub-section extends from the binder ring at the other end of the ring metal to the center binder ring. Both sub-sections are of the same width and this longitudinally raised section of the cover is also formed by a stamping operation. This results in formation of ribs 54 on either side of sub-sections 52*a*, 52*b*, the ribs extending longitudinally of the cover. Whereas ribs 44, 46, 48 formed in the cover strengthen the cover across its width, the ribs 54 now strengthen the cover along its length. In this regard, it will be noted that the ribs 50 on each side of the transversely extending raised section do not extend orthogonally to a longitudinal axis of the cover, but rather extend diagonally away from the associated binder ring (at approximately a 45° angle) from the respective sides of cover 20 to their intersection with longitudinally extending raised section 50. Such additional strengthening increases the tension in the cover material which, in turn, increases the tightness. This added tightness significantly improves the ability of the ring metal to withstand rough treatment without inadvertently or accidentally being opened. Heretofore, such capability to withstand this type of treatment without the binder opening has been dependent upon the strength of the binder rings.

Besides formation of the longitudinally extending raised section 52, the strength of cover 20 is further increased by the formation of geometric shaped detents 60 in raised section 52 and in each of the transversely extending raised sections 44, 46, and 48. As best shown in FIGS. 1 and 2, a diamond shaped detent 62 is formed in each transversely extending raised section, directly beneath the interfitting ends of the respective ring halves for each binder ring. A further diamond shaped detent 62 is also formed in each sub-section 52*a*, 52*b* of the longitudinally extending raised section 52. These detents are formed at the midpoint of each sub-section. An additional pair of detents 64 is also formed in each sub-section. These detents have a diamond shape which is elongated along the longitudinal axis of the cover, and each detent 64 is formed so as to be midway between the detent 62 formed in the sub-section and the respective binder rings at each end of the sub-section. As with the respective raised sections of cover 20, the detents 62, 64 are readily formed by a stamping operation. The resulting cover has a "diamondback" pattern as shown in the drawings.

Figure 10:
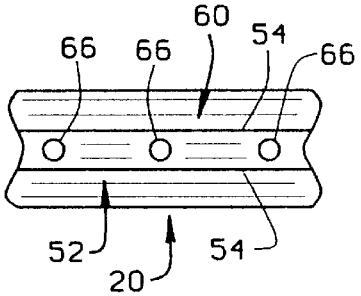
FIGS. 10 and 11 are partial views of a cover illustrating alternate detent shapes and patterns.
Figure 11:
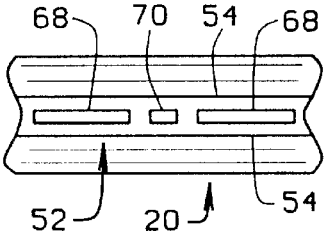

While the detents 62, 64 serve to increase the strength of cover 20, they additionally provide a decorative appearance to the cover. In this regard, it will be appreciated that other shapes of detents can be stamped into the cover. Convenient detent shapes include circles 66 as shown in FIG. 10, squares 68 as shown in FIG. 11, and rectangles 70, also as shown in FIG. 11. Other detent shapes can also be stamped in the raised section 52 of the cover without departing from the scope of the invention.

What has been described is a ring binder for storing paper, the ring binder having a ring metal with a plurality of binder rings each comprised of separate ring halves. The ring halves each have ends movable out of and into contact with each other to open and close the binder. A ring metal shield has a raised section extending transversely of the longitudinal axis of the shield at each ring location. The shield further includes a raised section extending longitudinally of the shield between each of the ribs, and detents formed in each longitudinal raised section. These raised sections and detents all serve to strengthen the shield. The detents include a plurality of spaced detents formed in each longitudinal raised section, and the detents formed in each longitudinal raised section form a decorative "diamondback" pattern which enhances the appearance of the ring metal. The raised sections of the cover, both longitudinally and transversely, have a number of different profiles, depending upon the shape and configuration of the raised sections, so to increase the ring metal tension. The ring metal is available in various sizes and is used with different numbers of binder rings.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A ring binder comprising:

a pair of leaves hingedly connected to each other for relative movement therebetween;

at least one binder ring formed of a pair of ring halves, one end of each ring half attached to a separate one of the leaves for movement of said leaves to move the ring halves to open and close the ring binder; and, a shield covering said leaves, said shield having a raised section extending outwardly and axially of a longitudinal centerline of said shield to increase the strength of said shield.

2. The ring binder of claim 1 further including at least one inwardly extending detent formed in said raised section of said shield to further strengthen said shield.

3. The ring binder of claim 2 wherein a plurality of spaced detents are formed in said raised section of said shield.

4. The ring binder of claim 3 further including a plurality of spaced binder rings each comprised of a pair of ring halves, each pair of ring halves being moveable to open and close the binder.

5. The ring binder of claim 4 wherein a plurality of spaced detents are formed in said section of said shield between each location of a binder ring to further strengthen said shield.

6. The ring binder of claim 5 wherein said detents are formed in a predetermined pattern.

7. The ring binder of claim 6 wherein said detents are each formed in one of a plurality of differing geometric shapes.

8. The ring binder of claim 7 wherein said shield further includes a raised section extending outwardly and transversely of the longitudinal centerline of said shield at each binder ring location.

9. The ring binder of claim 8 wherein sides of each transversely extending section extend diagonally from respective sides of said shield to a side of said longitudinally extending raised section.

10. The ring binder of claim 6 wherein said detents are formed of different geometric shapes and in a predetermined pattern of shapes.

11. In a ring binder having a pair of leaves hingedly connected to each other for relative movement therebetween, a binder ring formed of a pair of ring halves, one end of each ring half being attached to a separate one of the leaves whereby movement of the leaves moves the ring halves to open and close the ring binder, and a shield covering the leaves, the improvement wherein the shield has a first raised section extending outwardly and transversely of the longitudinal centerline of the shield at the binder ring location and a second raised section extending outwardly and axially of a longitudinal centerline of the shield to increase the strength of the shield.

12. The improvement of claim 11 further including a plurality of spaced binder rings each comprised of a pair of ring halves, each pair of ring halves being moveable to open and close the binder, and a plurality of spaced inwardly extending detents formed in a section of said shield between each location of a binder ring to further strengthen said binder.

13. The improvement of claim 12 wherein said detents are formed in a predetermined pattern.

14. The improvement of claim 13 wherein said detents are each of a geometric shape.

15. The improvement of claim 14 wherein said detents are formed of different geometric shapes and in a predetermined pattern of shapes.

16. The improvement of claim 12 further including a raised section extending transversely of the longitudinal centerline of the shield at each binder ring location.

17. The improvement of claim 16 wherein sides of each transversely extending section extend diagonally from respective sides of said shield to a side of said longitudinally extending raised section.

18. A ring binder comprising:

a pair of leaves hingedly connected to each other for relative movement therebetween;

a plurality of spaced binder rings each of which is formed of a pair of ring halves, one end of each ring half attached to a separate one of the leaves for movement of said leaves to move the ring halves forming said binder rings out of and into contact with each other to open and close the ring binder; and, a shield covering said leaves and having openings therein through which said ring halves extend, said shield having a plurality of raised sections extending outwardly and transversely of a longitudinal axis of the shield, one of said raised sections being at each binder ring location, and a raised section extending outwardly and axially of said longitudinal axis of said shield and intersecting each of said transversely extending raised sections, said axially extending raised section and said transversely extending raised sections being formed to increase the strength of said shield.

19. The ring binder of claim 18 wherein said axially extending raised section of said shield is comprised of a plurality of sub-sections each of which extends between one of said transversely extending raised sections and an adjacent transversely extending raised section, each sub-section having a plurality of spaced detents formed therein to further strengthen said shield.

20. The binder ring of claim 19 wherein said detents are formed of different geometric shapes and in a predetermined pattern of shapes.

21. The binder ring of claim 20 wherein said detents are each of a predetermined geometric shape.

22. The binder ring of claim 21 wherein three detents are formed in each said sub-section with each detent being of a diamond shape.

23. The binder ring of claim 22 wherein the middle detent formed in each sub-section is of a smaller diamond shape than the detents formed on either side thereof.

24. The ring binder of claim 18 wherein respective sides of each transversely extending section extend diagonally from respective sides of said shield to an adjacent side of said axially extending raised section.

25. The ring binder of claim 18 wherein said shield is constructed from a metal material, said axially extending raised section and said transversely extending raised sections being stamped in said metal shield.

26. A ring metal (20) for a ring binder (10) comprising:

a pair of leaves (28, 30) hingedly connected to each other for relative movement therebetween;

at least one binder ring (22) formed of a pair of ring halves (22*a,* 22*b*), one end of each ring half attached to a separate one of the leaves for movement of said leaves to move the ring halves to open and close the ring binder; and, a shield (40) covering said leaves, said shield having a raised section (52) extending outwardly and axially of a longitudinal centerline of said shield to increase the strength of said shield.

27. The metal ring of claim 26 further including a detent (60) formed in said raised section of said shield to further strengthen said shield.

28. The metal ring of claim 27 wherein a plurality of spaced detents (60) are formed in said raised section of said shield.

29. The metal ring of claim 28 wherein said shield further includes a raised section (44) extending outwardly and transversely of the longitudinal centerline of said shield at each binder ring location.

30. The metal ring of claim 29 wherein sides (50) of each transversely extending section extend diagonally from respective sides of said shield to a side (54) of said longitudinally extending raised section.

* * * * *